US010071496B2

(12) United States Patent
Weber

(10) Patent No.: US 10,071,496 B2
(45) Date of Patent: Sep. 11, 2018

(54) BLADE AND BLADE MOUNT FOR A CUTTING MACHINE

(71) Applicant: Weber Maschinenbau GmbH Breidenbach, Breidenbach (DE)

(72) Inventor: Gunther Weber, GroB Nemerow (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 488 days.

(21) Appl. No.: 14/681,230

(22) Filed: Apr. 8, 2015

(65) Prior Publication Data

US 2015/0290828 A1 Oct. 15, 2015

(30) Foreign Application Priority Data

Apr. 10, 2014 (DE) ..... 10 2014 105 130

(51) Int. Cl.
*B26D 7/26* (2006.01)

(52) U.S. Cl.
CPC ..... *B26D 7/2621* (2013.01); *B26D 2210/02* (2013.01)

(58) Field of Classification Search
CPC ..... B26D 7/2614; B26D 7/2621; B23D 1/02; B23D 1/10; B23D 1/14; Y10T 279/17888; Y10T 279/17897
USPC ..... 83/698.21, 698.41, 665, 666
See application file for complete search history.

(56) References Cited

U.S. PATENT DOCUMENTS 3,324,539 A * 6/1967 Cleland ..... B23D 61/10 125/13.02
3,827,421 A * 8/1974 Schumacher ..... B23D 61/10 125/13.02
3,955,551 A * 5/1976 Tang ..... B23D 61/10 125/13.02
4,070,941 A 1/1978 Lorenz
4,326,361 A * 4/1982 McGill ..... B23D 61/10 451/342
4,914,816 A * 4/1990 Fenn ..... B26B 21/38 30/45
5,373,766 A * 12/1994 Ranly ..... B23D 35/004 83/497
5,596,918 A * 1/1997 Longwell ..... B23D 35/008 493/365

(Continued)

FOREIGN PATENT DOCUMENTS

DE 7611681 U1 9/1976
DE 102006000360 A1 1/2008

(Continued)

*Primary Examiner* — Jason Daniel Prone
*Assistant Examiner* — Richard Crosby, Jr.
(74) *Attorney, Agent, or Firm* — Cantor Colburn LLP

(57) ABSTRACT

A blade mount for a cutting machine, in particular for a food slicing machine, includes a contact surface for a blade, a mount section for the blade projecting axially from the contact surface and at least one torque transmission element which projects axially from the contact surface, which is radially spaced apart from the mount section, which engages into the blade and in which a mount is formed for fastening the blade to the blade mount. Additionally, a blade is matched thereto, to a handling apparatus for assembling the blade at the blade mount, and to a system of blade mount, blade and handling apparatus.

15 Claims, 8 Drawing Sheets

(56) References Cited

U.S. PATENT DOCUMENTS

Figure 2A:
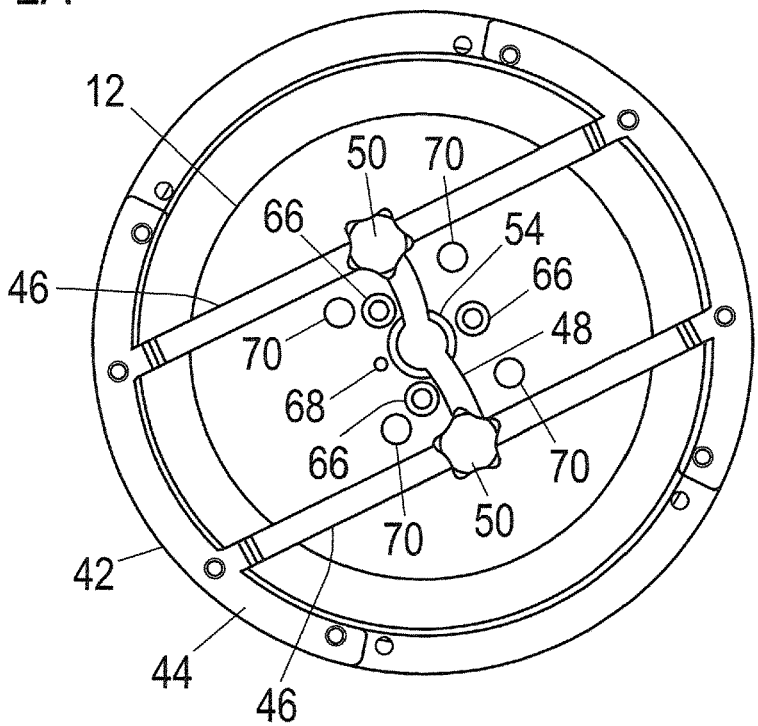

| | | | | |
|---|---|---|---|---|
| 5,924,208 | A * | 7/1999 | Saeki | B23D 61/10 30/122 |
| 6,360,737 | B1 * | 3/2002 | Kurtze | B23D 61/10 125/12 |
| 7,343,841 | B2 * | 3/2008 | Phillips | B23D 59/003 403/259 |
| 7,415,915 | B2 * | 8/2008 | Parrish | B26D 7/2621 30/158 |
| 7,666,070 | B2 | 2/2010 | Weber et al. | |
| 7,866,242 | B1 | 1/2011 | Harris | |
| 8,136,435 | B2 * | 3/2012 | Zhu | B26D 1/0006 83/478 |
| 9,636,844 | B2 * | 5/2017 | Wakita | B28D 5/02 |
| 2003/0188611 | A1 * | 10/2003 | Solberg | B26D 5/04 83/13 |
| 2004/0149101 | A1 * | 8/2004 | Solberg | B26D 7/2621 83/431 |
| 2006/0174736 | A1 * | 8/2006 | Bloy | B26D 7/2621 83/13 |
| 2007/0199421 | A1 * | 8/2007 | Mueller | B26D 1/16 83/469 |
| 2012/0048081 | A1 * | 3/2012 | Tanaka | B26D 1/205 83/34 |
| 2015/0020670 | A1 * | 1/2015 | Wakita | B27B 5/325 83/522.12 |
| 2015/0122100 | A1 | 5/2015 | Schmeiser | |
| 2015/0283721 | A1 * | 10/2015 | Mayer | B26D 1/14 83/591 |
| 2015/0290828 | A1 * | 10/2015 | Weber | B26D 7/2621 83/663 |
| 2016/0207216 | A1 * | 7/2016 | Nitta | B26D 7/2621 |

FOREIGN PATENT DOCUMENTS

| | | | |
|---|---|---|---|
| DE | 102009032974 | A1 | 1/2011 |
| WO | 2007103899 | A2 | 9/2007 |
| WO | 2012175404 | A1 | 12/2012 |
| WO | 2012175405 | A1 | 12/2012 |
| WO | 2013164144 | A1 | 11/2013 |

* cited by examiner

Fig. 1A
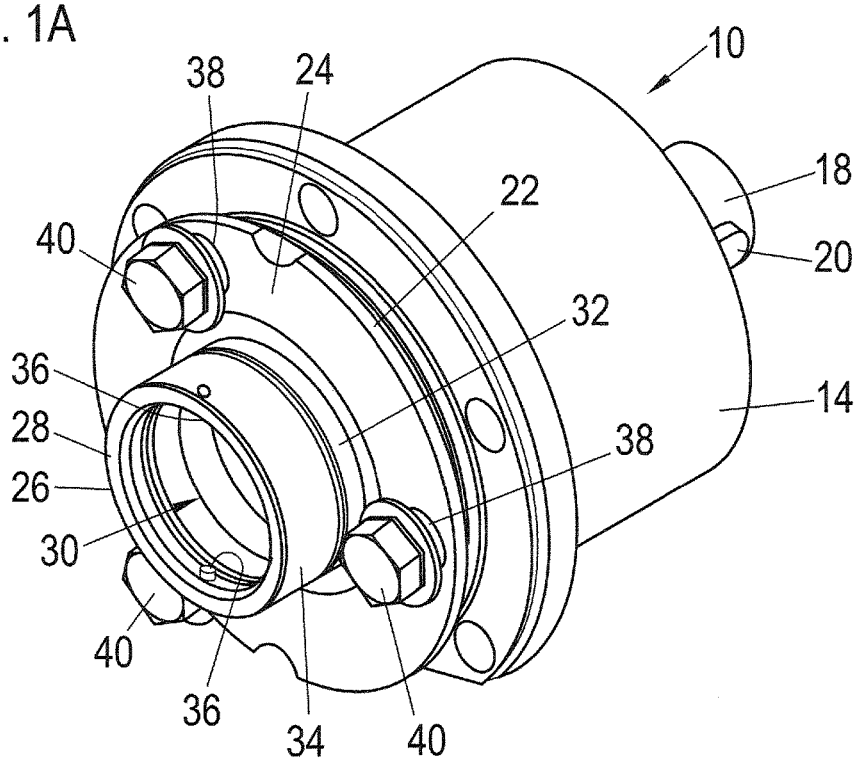
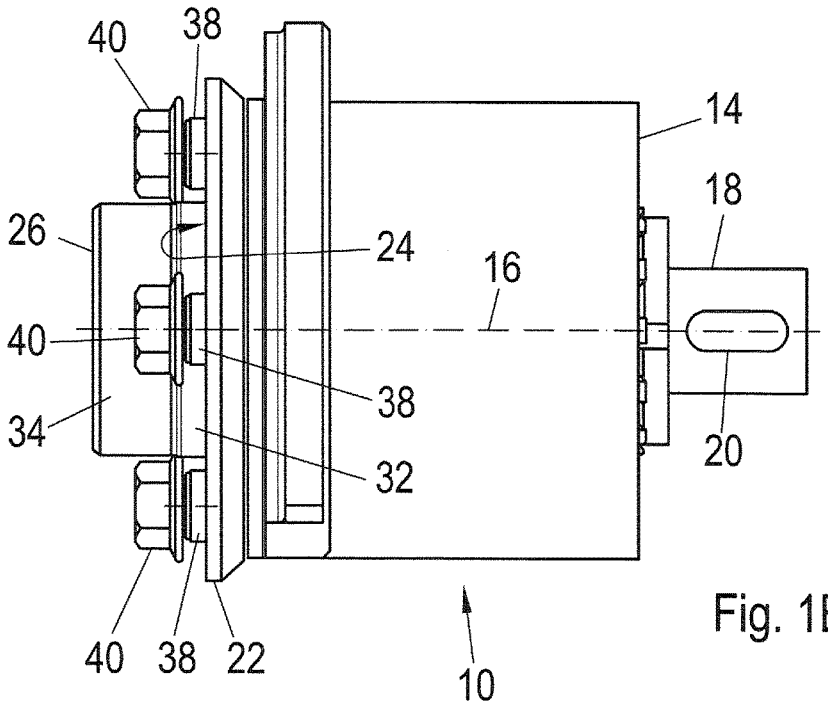
Fig. 1B

BLADE AND BLADE MOUNT FOR A CUTTING MACHINE

The invention relates to a blade for a cutting machine, in particular for a food slicing machine, to a blade mount of the cutting machine matched to the blade and to a handling apparatus for assembling or dismantling the blade at the blade mount.

Blades for food slicing machines, in particular for high-performance slicers, are sufficiently known and are as a rule configured in the form of circular blades or of scythe-like blades. The fastening of the blades to the blade mounts conventionally takes place by means of a central screw connection, in part in combination with a press plate placed below. Since here only one single fastening component is present, it has to have a very high reliability with respect to failure. In unfavorable cases, there is furthermore the possibility of an incorrect assembly of the central screw, in particular in combination with the press plate.

A decentralized multi-point screw connection of a blade to a blade mount is proposed to overcome these disadvantages in WO 2013/164144 A1, with a centrally arranged security additionally being provided which prevents the blade from being able to be released from the blade mount on a failure of the screw connection.

It is the underlying object of the invention to provide an alternative blade fastening which not only facilitates the assembly and dismantling of a blade at a blade mount, but furthermore also reduces the risk of an incorrect assembly.

This object is satisfied by the subject matters of the independent claims.

A blade mount in accordance with the invention for a cutting machine, in particular a food slicing machine, comprises a contact surface for a blade, a mount section for the blade projecting axially from the contact surface and at least one torque transmission element which projects axially from the contact surface, which is radially spaced apart from the mount section, which engages into the blade and in which a receiver is formed for a fastening means for fastening the blade to the blade mount.

The blade fastening in other words therefore does not take place centrally at the mount section, but rather in a decentralized manner at a torque transmission element spaced apart from the mount section. The torque transmission element thus satisfies a dual function in that it not only serves for the transmission of forces from the blade mount to the blade in the peripheral direction, but furthermore also serves for the fastening of the blade to the blade mount. Force transmission and shape matching between the blade and the blade mount therefore take place in accordance with the invention at one and the same point, namely at the torque transmission element. A shape matching must in particular be present before the force-transmitting connection can tighten at all.

This provides a substantial security advantage with respect to conventional blade fastenings in which a force-transmitting connection is realized between the blade and the blade mount by a centrally arranged screw and the shape-matched connection is realized by a pin radially spaced apart therefrom and in which the force-transmitting connection can be tightened without the shape-matched connection having to be latched, which can result in damage to the central screw and thus possibly to an uncontrolled release of the blade.

In accordance with a particularly simple construction embodiment of the blade mount, an internal thread is formed for the receiving of a screw provided for the screw connection of the blade to the blade mount in the torque transmission element, i.e. the force transmission between the blade and the blade mount is achieved by a screw connection. In principle, however, other types of force-transmitting connections can also be considered such as a clamping of the blade to the blade mount at the torque transmission points.

To establish the force-transmitting connection of the blade to the blade mount, it is advantageous if an axial dimension of the or each torque transmission element is smaller than an axial dimension of the blade in the region of the torque transmission element. It is hereby ensured that the torque transmission element admittedly engages into the mounted blade, but does not project through it and in particular does not protrude from it on the side remote from the blade mount, which would make a screw connection or a clamp connection more difficult. The torque transmission element can, for example, engage half-way or two-thirds of the way into the blade.

The axial dimension of the or each torque transmission element can generally, however, also be larger than the axial dimension of the blade in the region of the torque transmission element. In this case, the fastening means provided for fastening, however, has to be configured such that a sufficient force for clamping or screwing the blade can nevertheless be applied. For example, a sufficiently deep undercut can be provided at the screw head for this purpose.

To ensure a stability of the torque transmission element required for the torque transmission, a ratio of the internal thread diameter to the outer diameter of the or each torque transmission element preferably lies in the range from 0.5 to 0.9. An outer diameter of the mount section can be twice as large as, up to eight times larger, and for example three times larger, than an outer diameter of the or each torque transmission element.

The or each torque transmission element preferably has an outer contour matched to an associated aperture of the blade for a particularly effective torque transmission, i.e. the torque transmission element engages with an exact fit into the associated aperture of the blade. For example, the or each torque transmission element can have a centering collar which projects concentrically about the internal thread from the contact surface of the blade mount and which dips into an associated aperture of the blade. The height of the torque transmission element is set back with respect to that of the mount section to allow the prefixing of the blade to the mount section.

Alternatively or additionally to a shape matching between the torque transmission element and the aperture of the blade, a centering can also take place by the fastening means itself in that e.g. a fastening means configured as a screw is provided with a cone at its screw head and the aperture of the blade is encompassed by a matched sloping surface. The torque transmission element in this case therefore does not have to dip with an exact fit into the aperture of the blade.

A further variant of a self-centering by the fastening means comprises the torque transmission element projecting out of the contact surface in the form of a threaded pin and the fastening of the blade to the blade mount taking place by means of a screw element having an internal thread which is screwed onto the threaded pin and in this respect effects a shape matching between the blade and the torque transmission element. The shape matching or the centering is therefore also integrated into the screw element here.

In principle, it would even be conceivable to dispense with the torque transmission element completely and instead only to provide a threaded bore in the contact surface of the blade mount. The screw head would also have to have a cone for a self-centering by the screw in this case and the aperture of the blade would have to be encompassed by a matched sloping surface. This variant in other words therefore follows the principle of the wheel bolt.

A plurality of torque transmission elements, and in particular three torque transmission elements, are advantageously provided. Since the torque transmission elements simultaneously serve as fastening points for the blade, a secure blade fastening is achieved by the arrangement of a plurality of torque transmission elements, with the blade fastening still reliably holding the blade at the blade mount even on a failure of a fastening means. For reasons of simplicity, each of the torque transmission elements simultaneously forms a fastening point for the blade. It is, however, also generally conceivable not to provide each of the torque transmission elements with a receiver for a blade fastening means. If, for example, four torque transmission elements are present, it would by all means be possible only to configure two of the torque transmission elements, preferably two oppositely disposed torque transmission elements, as fastening points for the blade, while the respective other two torque transmission elements only serve for the force transmission.

All the torque transmission elements preferably have the same radial spacing from the mount section and/or all the torque transmission elements are arranged evenly distributed along a circular path arranged concentrically with the mount section, i.e. they are arranged on a common circle about the mount section located at the center. Such a rotationally symmetrical arrangement of the torque transmission elements not only contributes to a minimization of an imbalance of the blade, but furthermore also facilitates the assembly of the blade at the blade mount. It is, however, also generally conceivable that the torque transmission elements do not all have the same spacing from the mount section and/or are not arranged evenly distributed.

In accordance with a further embodiment, the mount section is configured as cylindrical at least sectionally and is in particular matched to an associated circular central opening of the blade. At least one part section of the mount section adjacent to the contact surface can form a fit corresponding to the central opening of the blade to ensure a seat of the blade contacting the contract surface at the blade section which is as free of clearance as possible. In contrast, a free end of the mount section remote from the contact surface can have an outer diameter reduced with respect to the part section adjacent to the contact surface. The mount section can taper step-wise or can also have a certain conicity regionally to provide a certain "threading aid" by which the introduction of the mount section into the central opening of the blade is facilitated and the fit between the blade and the mount section is preserved between the blade and the mount section in the end position of the blade contacting the contact surface.

In accordance with a further embodiment, the mount section defines an inner space which is in particular cylindrical and which is open at the front end, i.e. at its end remote from the contact surface and is aligned concentrically with the mount section so that an annular wall arises. In other words, the mount section is therefore formed as hollow cylindrical at least in part.

At least one prefixing pin preferably projects radially from the annular wheel into the inner space. Two prefixing pins are preferably provided which are ideally arranged evenly distributed viewed in the peripheral direction of the annular wall, i.e. therefore have an offset of 180°. The assembly of a blade at the blade mount is particularly simple when there is a symmetry in the relation between the prefixing pins and the torque transmission elements, i.e. when the prefixing pins have the same angle offset with respect to one another as the torque transmission elements and thus the fastening points. It is, however, generally also possible to provide a different number of prefixing pins, on the one hand, and torque transmission elements, on the other hand. For example, only two prefixing pins can also be provided with three torque transmission elements. It is generally even possible only to provide one prefixing pin. The prefixing pin serves for a prefixing of the blade to the blade mount on the assembly of the blade, as will be explained in more detail in the following. The assembly of a blade, for example on a blade change, can be carried out more ergonomically than previously thanks to the prefixing, in particular because the weight of the blade is already taken up in the prefixed state.

In accordance with a further advantageous embodiment, the blade mount forms a construction unit which is replaceably mounted at a blade head of the cutting machine. Already existing cutting machines can hereby also easily be retrofitted with a blade mount in accordance with the invention. It is understood that the blade mount can have torque transmission means which can be coupled to the blade head at its side remote from the mount section for the blade. The blade head can accordingly have a pivot bearing for a rotatable support of the blade head at the cutting machine at its side remote from the blade mount and/or can have a torque transmission means, e.g. a shaft extension with a belt pulley placed thereon.

A further subject of the invention is a blade, e.g. a circular blade or a scythe-like blade, for a cutting machine, in particular for a food slicing machine, having a central opening which corresponds to a mount section of a blade mount of the cutting machine, in particular a blade mount of the above-described manner, and having at least one aperture radially spaced apart from the central opening for the passage of a fastening means, e.g. a screw or a clamping element, provided for fastening the blade to the blade mount and respectively associated with a torque transmission element axially projecting from the blade mount, wherein the contour of the or each aperture is matched to the outer contour of the torque transmission element. Such a blade allows a fastening to the blade mount in accordance with the invention in the manner described above, whereby the advantages already named above can be reached accordingly.

Depending on the number of torque transmission elements of the blade mount, the blade can have a plurality of apertures and in particular a number of apertures matched to the number of the torque transmission elements, for example three apertures.

All the apertures of the blade have, in accordance with the torque transmission elements of the blade mount, the same radial spacing from the central opening and/or all the apertures can be arranged evenly distributed along a circular path arranged concentrically with the central opening, i.e. they are then arranged evenly distributed over a common circle about the central opening. It is, however, also generally conceivable that the apertures do not all have the same spacing from the central opening and/or are not arranged evenly distributed.

The central opening of the blade is advantageously matched to the contour of the associated mount section of the blade mount and is in particular of circular shape.

The blade moreover preferably has a bore for receiving a rotary driving pin axially projecting from a blade mount.

The bore also allows an assembly of the blade in accordance with the invention at a conventional blade mount which provides a force-transmitting connection of the blade to the blade mount by means of a central screw connection and which provides a shape-matched connection by means of a decentralized rotary driving pin. In this manner, a blade in accordance with the invention can also be used in those cutting machines whose blade head has not yet been retrofitted with a blade mount in accordance with the invention. A conversion of the cutting machine to blades in accordance with the invention is consequently also possible without a simultaneous replacement of the blade mount.

A further subject of the invention is furthermore a handling apparatus for assembling or dismantling a blade, in particular of the above-described kind, at a blade mount of a cutting machine, in particular a blade mount of the above-described kind, having a means for the releasable attachment of the handling apparatus to the blade and having a prefixing element which is attached, in particular rotationally fixedly attached, to the handling apparatus, which can pass through a central opening of the blade attached to the handling apparatus and which can be introduced into an inner space of a mount section of a blade mount of the cutting machine.

Such a handling apparatus not only facilitates the transport of the blade, but can furthermore, provided it covers a cutting edge of the blade, also protect a person handling the blade from injuries by the blade. The handling apparatus can therefore also be called a blade protection.

The blade can be prefixed for a subsequent fastening to the blade mount by means of the prefixing element optionally passing through the central opening of the blade and introduced into the inner space of the mount section, wherein the prefixing of the blade at the blade mount does not take place directly, but rather indirectly since the handling apparatus is actually prefixed at the blade mount to which the blade is in turn attached. The assembly of the blade at the blade mount is substantially simplified by the prefixing since the fitter can in principle let go of the handling apparatus after the prefixing and can concentrate with both hands on the fastening, e.g. screwing or clamping, of the blade to the blade mount. The reaching for the fastening means and the tools required for clamping is in particular simplified in accordance with the invention.

In accordance with an embodiment, the prefixing element is configured as cylindrical and is in particular matched to the contour of the inner space. The fixing element introduced into the inner space can be rotated relative to the mount section in this manner and can in this respect be stored largely free of play in it. The prefixing element can also be hollow cylindrical, that is so-to-say form a prefixing sleeve, and can thereby receive an end section of the blade shaft projecting beyond the contact surface in it.

At least one guide, in particular a slot guide, for at least one prefixing pin of the blade mount projecting radially into the inner space is preferably provided at a jacket surface of the prefixing element. The guide and the prefixing pin ideally allow a latching of the prefixing element at the blade mount. Specifically, the guide can be configured so that it allows a first axial movement of the prefixing element into the inner space and then a rotation of the prefixing element in the inner space. In this manner, the prefixing of the blade at the blade mount can be executed by two simple movements, namely (a) pushing the handling apparatus with the blade onto the mount section and (b) rotating the handling apparatus with the blade relative to the blade mount.

The guide is configured as a slot guide in accordance with a particularly simple constructional embodiment and comprises an axially extending first groove section and a second groove section adjoining it and extending in the peripheral direction. The prefixing pin is pushed along the first groove section by the first axial movement for the prefixing. The prefixing pin is brought into the second groove section by the subsequent rotation of the prefixing element, whereby the prefixing element is now latched in the mount section and cannot drop from the blade mount by accident without a corresponding rotation of the handling apparatus in the opposite direction. It is understand that the length of the first groove section is dimensioned such that the handling apparatus with the blade can be rotated without the blade in so doing coming into contact with the torque transmission elements of the blade mount or moving into a latch position. The length of the second groove section is in contrast dimensioned such that the blade can be rotated at least so far until the apertures of the blade are aligned with the torque transmission elements of the blade mount. As soon as this is the case, the blade can be pushed further onto the mount section via the handling apparatus until it contacts the contact surface of the blade mount and the torque transmission elements engage into the apertures of the blade.

To allow a second axial movement of the prefixing element associated therewith into the inner space of the mount section, the slot guide can additionally comprise an axially extending third groove section which, starting from the second groove section, extends in a direction opposite to the first groove section and in which the prefixing pin moves during the second axial movement of the prefixing element. It is, however, also alternatively possible to configure the width of the second groove section extending in the peripheral direction at least regionally, e.g. in an end region of the second groove section remote from the first groove section, as larger than a maximum dimension of the prefixing pin viewed in the axial direction. The prefixing pin can thereby move sufficiently far within the second groove section during the second axial movement of the prefixing element.

A further subject of the invention is moreover a system, comprising a blade mount of a cutting machine, in particular a blade mount of the above-described kind, a blade, in particular of the above-described kind, which can be fastened to the blade mount and a handling apparatus, in particular of the above-described kind, which can be attached to the blade, wherein the blade can be prefixed to the blade mount by means of the handling apparatus for a fastening to the blade mount.

As already mentioned, the prefixing of the blade to the blade mount preferably takes place by a first axial movement and by a subsequent rotation of the handling apparatus relative to the blade mount.

Specifically, the prefixing of the blade to the blade mount can take place by introducing a prefixing element of the handling apparatus in an inner space of an associated mount section of the blade mount and a guided rotation of the prefixing element in the inner space. In this respect, apertures of the blade can be aligned with associated torque transmission elements simultaneously with the rotation of the prefixing element and the apertures of the blade can be pushed onto the associated torque transmission elements on a subsequent further introduction of the prefixing element into the inner space until the blade contacts the contact surface of the blade mount.

It results as a further advantage due to the construction in accordance with the invention and to the dispensing with of the previous press plate as an additional part that the revolving mass is lower. The bearing load in the blade head is thereby also reduced. In addition, the wall thickness of the blade can optionally be selected as smaller than previously since the force introduction takes place via a plurality of fastening points.

It must finally be pointed out that a cutting machine equipped with the blade mount in accordance with the invention and with the blade in accordance with the invention cannot only be used for slicing foods, but can rather generally also be considered for slicing other materials such as plastic materials.

Figure 2B:
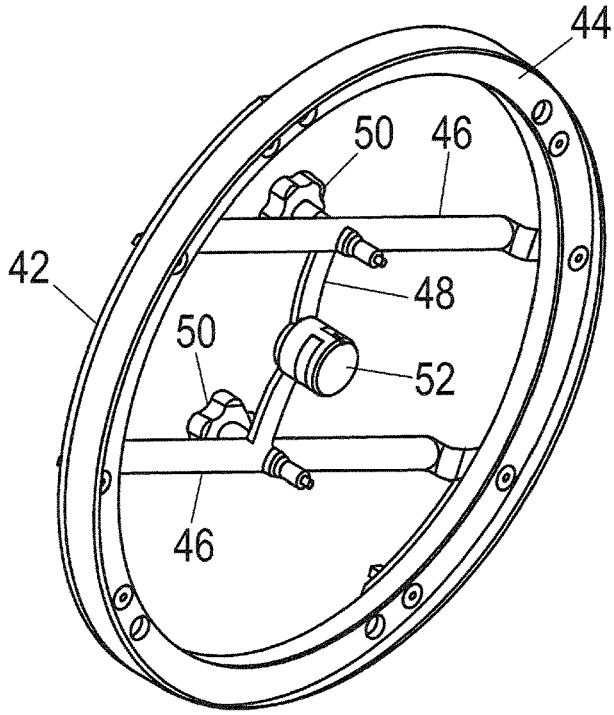
Figure 3A:
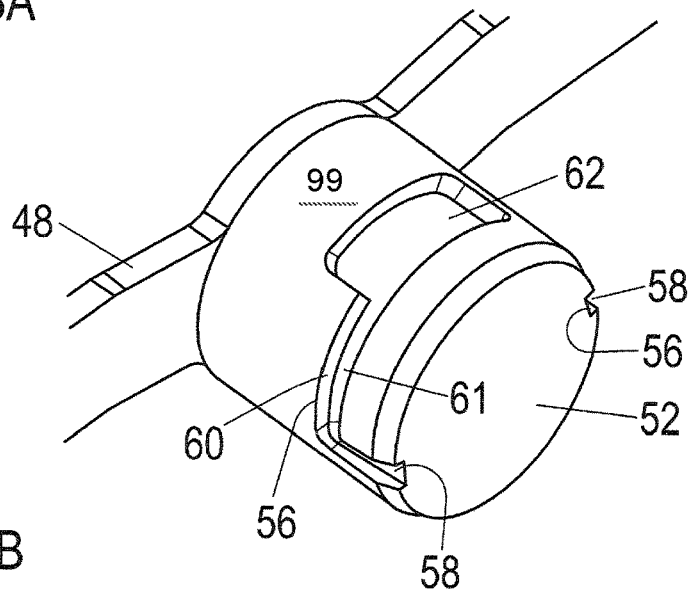
Figure 3B:
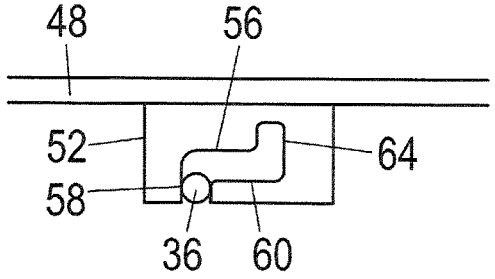
Figure 4:
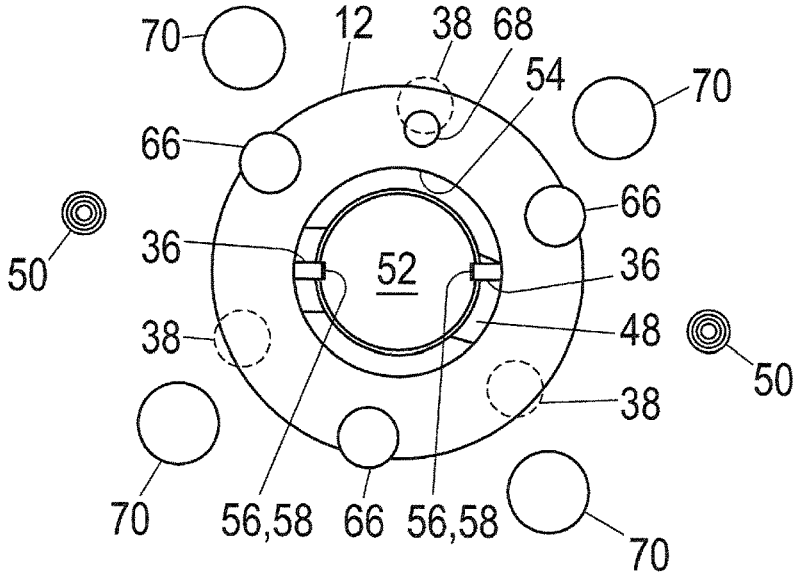
Figure 5A:
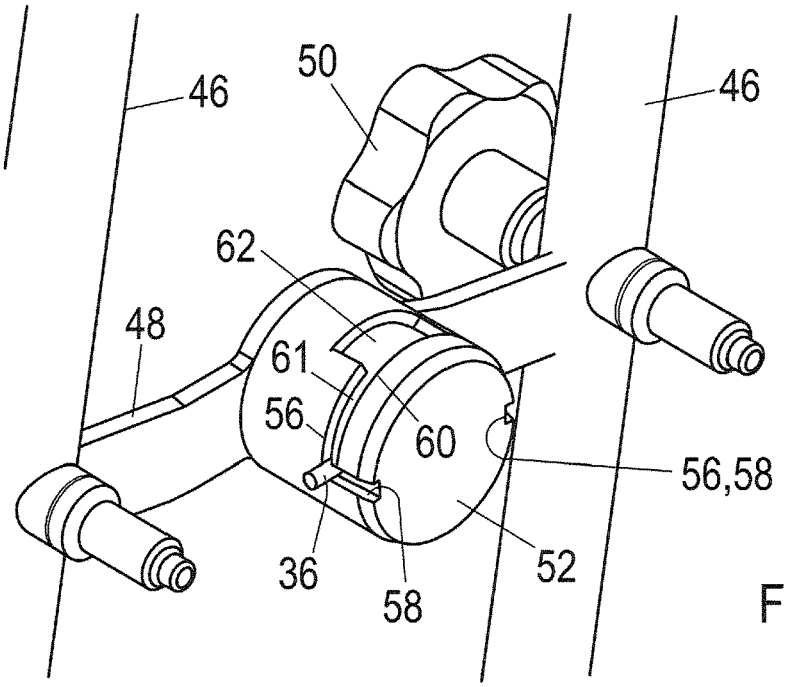
Figure 5B:
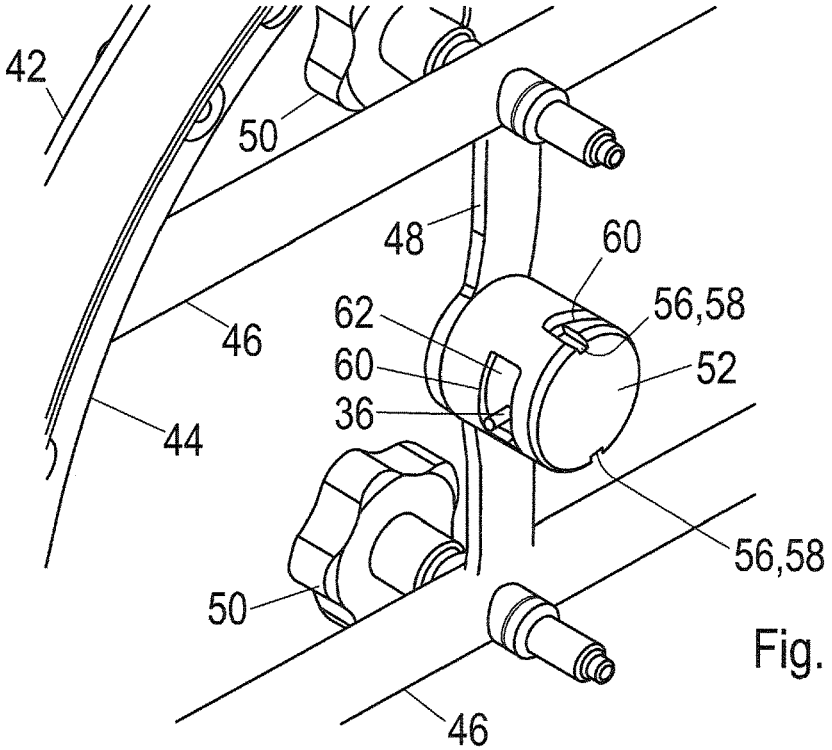
Figure 5C:
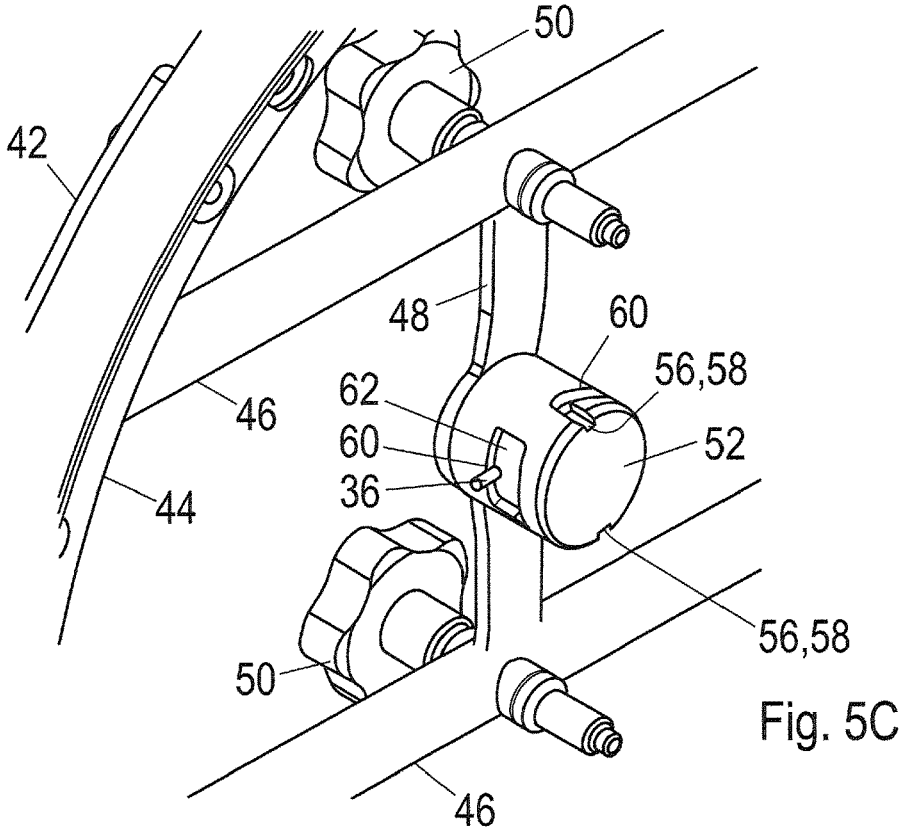
Figure 5D:
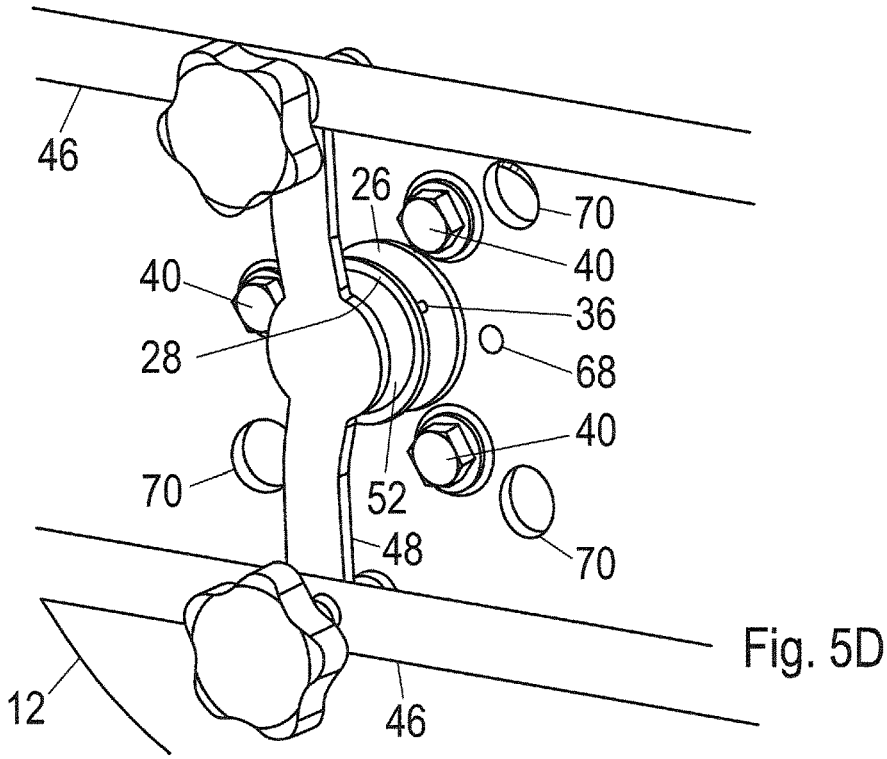
Figure 6:
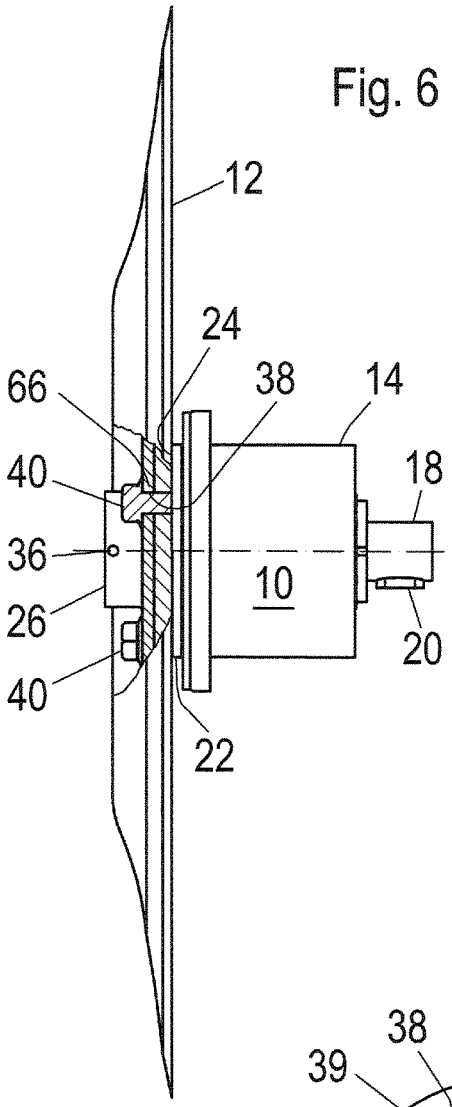
Figure 7A:
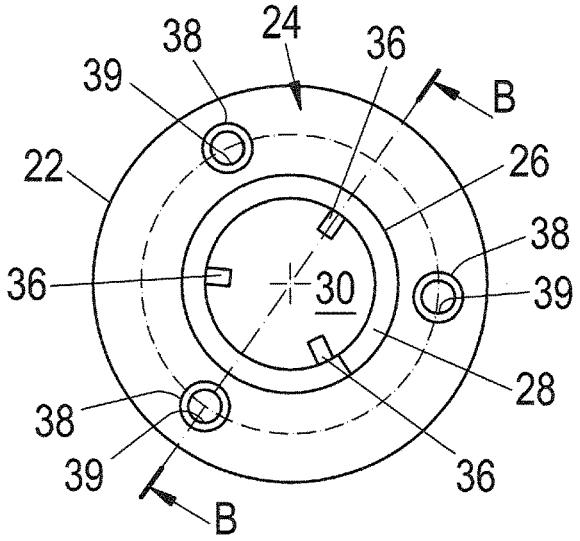
Figure 7B:
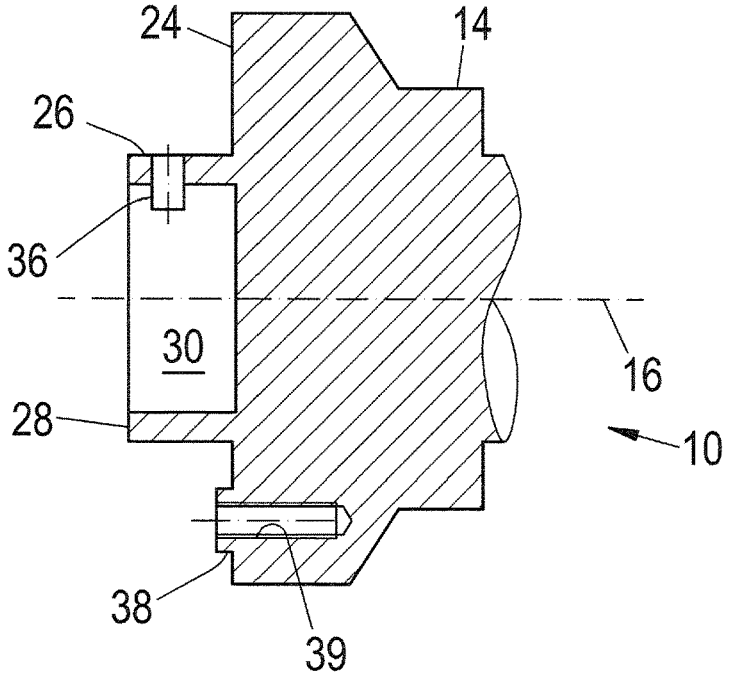
Figure 7C:
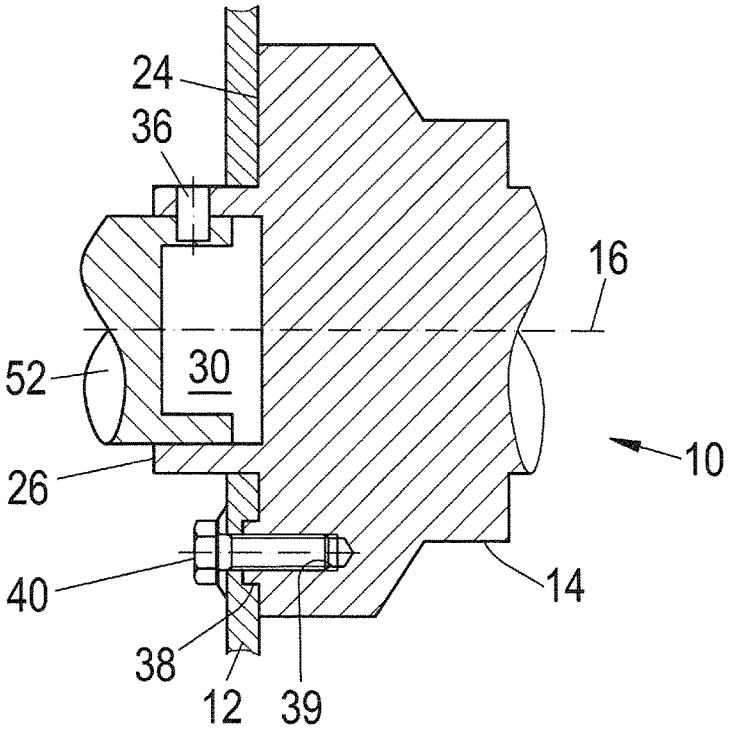
Figure 8A:
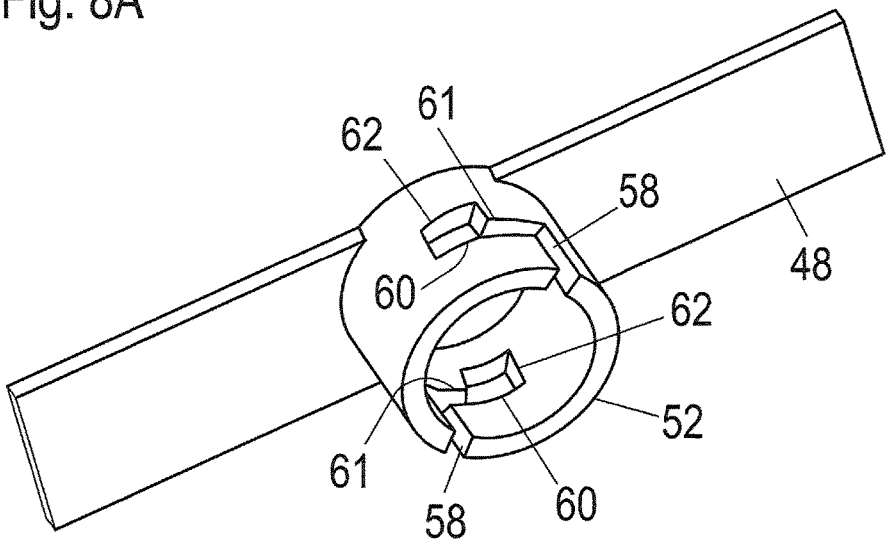

The invention will be described in the following purely by way of example with reference to possible embodiments and to the enclosed drawing. There are shown:

FIG. 1A a perspective view of a blade mount in accordance with the invention in accordance with a first embodiment;

FIG. 1B a side view of the blade mount of FIG. 1A;

FIG. 2A a front view of a handling apparatus in accordance with the invention with a blade;

FIG. 2B a perspective rear side view of the handling apparatus of FIG. 2A without a blade;

FIG. 3A a perspective view of a prefixing element of the handling apparatus of FIG. 2;

FIG. 3B a schematic side view of an alternative prefixing element;

FIG. 4 a section through the blade mount of FIG. 1 with a handling apparatus placed thereon with a blade in the plane of prefixing pins;

FIG. 5A a perspective view of the handling apparatus of FIG. 2 with prefixing pins engaging into the prefixing element in a first rotary position;

FIG. 5B a perspective view of the handling apparatus of with prefixing pins engaging into the prefixing element in a second rotary position;

FIG. 5C a perspective view of the handling apparatus with prefixing pins engaging into the prefixing element in a second rotary position, but pushed further onto the blade mount;

FIG. 5D the handling apparatus in the position of FIG. 5C with a blade screwed onto the blade mount;

FIG. 6 a side view shown partly in section of the blade screwed to the blade mount;

FIG. 7A a schematic front view of a blade mount in accordance with a second embodiment;

FIG. 7B a sectional view of the blade mount of FIG. 7A;

FIG. 7C a sectional view of the blade mount of FIGS. 7A and 7B with a prefixing element introduced therein and with a blade screwed thereat;

FIG. 8A a perspective view of a further alternative prefixing element; and

Figure 8B:
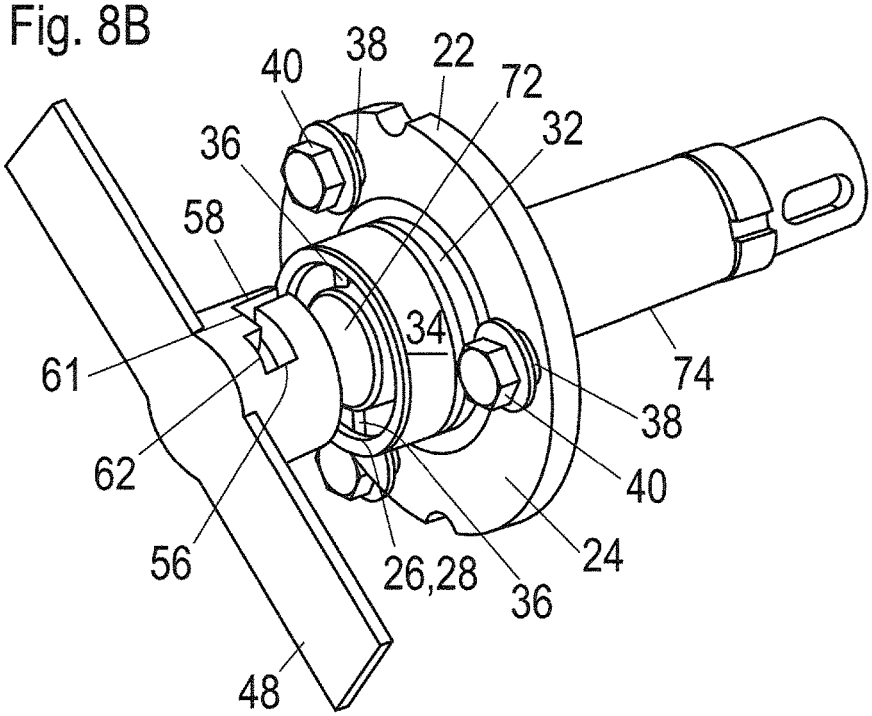

FIG. 8B a perspective view of the prefixing element of FIG. 8A with a corresponding blade mount.

FIG. 1 shows a blade mount 10 in accordance with the invention in accordance with a first embodiment which serves for the support of a blade 12 (FIG. 2A) at a cutting machine, not shown, in particular at a food slicing machine, such as a high-performance slicer.

The blade mount 10 comprises a cylindrical base body 14 whose longitudinal central axis 16 coincides with an axis of rotation of the blade 12. The longitudinal central axis 16 in this context forms the reference axis for the terms "axial" and "radial".

Means for a torque-transmitting coupling of the blade mount 10 to a blade head, not shown, of the cutting machine, here an axially extending shaft extension 18 with a key 20, are provided at a rear side of the blade mount 10.

At a front side facing the blade 12, the blade mount 10 has a flange 22 which forms a contact surface 24 for the blade 12 which extends in a plane orientated at a right angle to the longitudinal central axis 16.

A hollow cylindrical mount section 26 projects from the contact surface 24, said mount section being formed by a ring wall 28 which is aligned coaxially with the longitudinal central axis 16 and which bounds a cylindrical inner space 30. A rear part section 32 of the ring wall 28 adjacent to the contact surface 24 has a somewhat larger outer diameter than a front part section 34 of the ring wall 28 remote from the contact surface 24. Two diametrically arranged prefixing pins 36 are let into the ring wall 28 in the region of the front free end of the mount section 26 and project radially into the inner space 30.

Furthermore, three axially projecting torque transmission elements 38, here in the form of cylindrical sockets, protrude from the contact surface 24. Each torque transmission element 38 is provided with an internal thread 39 into which a screw 40 can be screwed for fastening the blade 12 to the blade mount 10. The torque transmission elements 38 are equally spaced apart from one another, i.e. are arranged around the mount section 26 with an angular offset of 120°, and indeed along a circular path arranged concentrically with the longitudinal central axis 16, so that all the torque transmission elements 38 have the same radial spacing from the mount section 26.

The assembly of the blade 12, here a circular blade, takes place by means of a handling apparatus 42 which is releasably attached to the blade 12 and which is shown in more detail in FIG. 2. The handling apparatus 42 comprises a protection ring 44 which engages around a cutting edge of the blade 12 and covers it protectively. Furthermore, the handling apparatus 42 has two longitudinal struts 46 which extend in parallel with one another, which have a respective equal spacing from a center point of the protective ring 44, which are of the type of a chord and which are connected to one another by a transverse strut 48 extending through the center of the protective ring 44. Toggle screws 50 are rotatably supported at the points of intersection of the longitudinal struts 46 with the transverse strut 48 and the handling apparatus 42 can be releasably attached to the blade 12 by them.

A prefixing element is rotationally fixedly formed at the transverse strut 48 at the center of the handling apparatus 42 and projects through a central opening 54 of the blade 12 and could generally taper slightly conically, starting from the transverse strut 48, but which in the present embodiment has a cylindrical base shape. Its outer diameter is matched to the inner diameter of the hollow cylindrical mount section 26 of the blade mount 10 so that the prefixing element 52 can be introduced with an exact fit into the inner space 30 of the mount section 26. The prefixing element 52 serves for a prefixing of the handling apparatus 42 to the blade mount 10 on the assembly of the blade 12 at the cutting machine.

For this purpose, a slot guide 56 is formed in a jacket surface 99 (FIG. 3A) of the prefixing element 52 at the handling apparatus 42 for every prefixing pin 36 of the blade mount 10. Each slot guide 56 has a first groove section 58 which extends axially from the free end face of the prefixing element 52 remote from the transverse strut 48 and whose end is adjoined by a second groove section 60 extending in the peripheral direction. The width of the first groove sections 58 and first regions 61 of the second groove sections 60 adjacent thereto is slightly larger than an outer dimension of the prefixing pins 36 to be guided. End regions 62 of the second groove sections 50 remote from the first groove sections 58 in contrast have a width which corresponds to a multiple of the outer dimension of the prefixing pins 36 so that an axial movement of the prefixing pin 36 in the end regions 62 is possible.

Alternatively, the second groove sections 60 extending in the peripheral direction can, as is shown in FIG. 3B, continuously have a width matched to the prefixing pins 36 and can merge in each case at their ends remote from the first groove section 58 into a third groove section 64 which extends axially in the direction of the transverse strut 48, i.e. in a direction opposite to the first groove section 58.

In both cases, the axial first groove sections 58 with the prefixing pins 36 are arranged corresponding diametrically at the prefixing element 52. The length of the first groove sections 58 is in this respect coordinated to the axial extent of the torque transmission elements 38 provided at the contact surface 24 such that, when the prefixing pins 36 introduced into the first groove sections 58 abut the ends of the first groove sections 58 facing the transverse strut 48, the blade 12 attached to the handling apparatus 42 just does not yet contact the torque transmission elements 38, but can rather be rotated past them while the prefixing pins 36 move along the second groove sections 60.

The length of the second groove sections 60 in the peripheral direction is dimensioned in this respect such that the handling apparatus 42 can be rotated at least so far relative to the blade mount 10 until three apertures 55 provided in the blade 12 for receiving the torque transmission elements 38 are aligned with the torque transmission elements 38. As can be recognized in FIG. 2A, the apertures 66 are arranged along a circular track concentrically aligned with the central opening 54, and indeed evenly distributed in accordance with the torque transmission elements 38, i.e. with an angular offset of 120°, and each with the same radial spacing from the axis of rotation of the blade 12 as the torque transmission elements 38.

For the assembly of the blade 12 at the blade mount 10, the handling apparatus 42 with the blade 12 attached thereto is engaged at the blade mount 10 such that the prefixing element 54 of the handling apparatus 42 is coaxially aligned with the mount section 26 of the blade mount 10 and the position of the first groove sections 58 of the slot guides 56 coincide with the position of the prefixing pins 36. Next, the handling apparatus 42 is pushed onto the mount section 26 of the blade mount 10, wherein the prefixing pins 36 move along the first groove sections 58 of the slot guide 56 until they abut the ends of the first groove sections 58 facing the transverse strut 48 (FIG. 5A). The blade 12 now still has a minimal spacing from the torque transmission elements 38. At the same time, the apertures 66 of the blade 12 are arranged in this situation with an angular offset form the torque transmission elements 38 (FIG. 4), which is achieved by a corresponding arrangement of the blade 12 at the handling apparatus 42, specifically by an arrangement of the threaded bores for the toggle screws 50 in the blade 12 with an angular offset from the apertures 66

The handling apparatus 42 is next rotated relative to the blade mount 10 for the alignment of the apertures 66 of the blade with the torque transmission elements 38 of the blade mount 10. The prefixing pins 36 in this respect move along the second groove sections 60 extending in the peripheral direction and thus secure the fixing element 52 against a falling out from the mount section 26. I.e. the handling apparatus 42, and thereby also the blade 12, are prefixed at the blade mount 10.

If the apertures 66 of the blade 12 have been brought into alignment with the torque transmission elements 38 of the blade mount 10, the prefixing pins 36 are located in the extended end regions 62 of the second groove sections 60, or alternatively in the third groove sections 64, and thus allow a further axial movement of the prefixing element 62 into the mount section 26.

In this angular position, the handling apparatus 42 is now pushed further onto the blade mount 10 until the blade 12 contacts the contact surface 24, the rear part section 32 of the mount section 26 is seated with an exact fit in the central opening 54 of the blade 12 and the torque transmission elements 38 engage with an exact fit into the apertures 66. For screwing the blade 12 to the blade mount 10, the screws 40 are now guided through the apertures 66, are each brought into engagement with the internal threads 39 of the torque transmission elements 38 and are tightened with a predefined torque. In this respect, the handling apparatus 42 serves for the holding up.

Finally, the handling apparatus 42 is released from the blade 12 by a corresponding actuation of the toggle screws 50, is rotated back relative to the blade mount 10 until the first groove sections 58 are again aligned with the prefixing pins 36 and is removed from the blade mount 10. The blade 12 thus mounted at the blade mount 10 is shown in FIG. 6.

In FIG. 7, a second embodiment of a blade mount 10 is shown which above all differs from the above-described first embodiment in that not two, but three prefixing pins 36 project into the inner space 30 of the mount section 26. The prefixing pins 36 are arranged evenly distributed along the inner periphery of the ring wall 28 and thus have an angular section of 120° with respect to one another. At the same time, the prefixing pins 36 are arranged with an angular offset of 60° from the torque transmission elements 38. The prefixing element of the handling apparatus 42 accordingly has three slot guides 56 for the prefixing pins 36.

This second embodiment with three prefixing pins 36 has the advantage with respect to the first embodiment with only two prefixing pins 36 that the prefixing pins 36 can be introduced into any desired first groove sections 58 of the handling apparatus 42, i.e. there are three possible starting angular positions of the handling apparatus 42 for the assembly of the blade 12 at the blade mount 10. In contrast, the correct pairing of the prefixing pins 36 and the first groove sections 58 must be observed in the first embodiment with only two prefixing pins 36 since the handling apparatus 42 can be rotated less far, and in particular not sufficiently far, in the case of an opposite pairing with respect to the other starting angular positions to bring the apertures 62 of the blade 12 into alignment with the torque transmission elements 38 of the blade mount 10.

To allow a mounting of the blade 12 also at those blade mounts 10 which provide a central fastening, e.g. screw connection, of the blade 12 and which provide a decentrally arranged pin for the torque transmission, the blade 10 has a decentralized bore 68 for receiving this pin, not shown, with the bore being able to be arranged in the region of the circle path on which the apertures 66 lie (FIG. 2A).

In addition, the blade 12 has four circular openings 70 which lie outside the circle path defined by the apertures 66 and which are in relation with an embodiment of the blade 12 known from the prior art. The openings 70 are optional and can also be omitted.

A further alternative embodiment of a prefixing element 52 which is attached to a transverse strut 48 of a handling apparatus 42 otherwise not shown in any more detail and which differs from the prefixing element 52 shown in FIG. 5 in that it is not formed as a solid body, but as a hollow cylinder is shown in FIG. 8. Two slot guides 56 are introduced into the wall of the hollow cylinder which serve for the receiving of a respective prefixing pin 36 of the blade mount 10 and in this respect allow a prefixing and positioning of the blade 12 at the blade mount 10 in the already described manner. The hollow cylindrical design of the prefixing element 52 allows the reception of an end section 72 of a blade shaft 74 projecting beyond the contact surface 24 of the blade mount 10.

REFERENCE NUMERAL LIST

10 blade mount
12 blade
14 base body
16 longitudinal central axis
18 shaft extension
20 key
22 flange
24 contact surface
26 mount section
28 ring wall
30 inner space
32 rear part section
34 front part section
36 prefixing pin
38 torque transmission element
39 internal thread
40 screw
42 handling apparatus
44 protective ring
46 longitudinal strut
48 transverse strut
50 toggle screw
52 prefixing element
54 central opening
56 slot guide
58 first groove section
60 second groove section
61 first region
62 end region
64 third groove section
66 aperture
68 bore
70 opening
72 end section
74 blade shaft

What is claimed is:

1. A blade mount for a cutting machine, comprising:
a contact surface for a blade;
a mount section for the blade axially projecting from the contact surface; and
at least one torque transmission element which projects axially from the contact surface, which is radially spaced apart from the mount section, which engages into the blade and in which a receiver for a fastening means is formed for fastening the blade to the blade mount,
wherein the mount section defines an inner space and at least one prefixing pin projects radially into the inner space.

2. The blade mount in accordance with claim 1,
in which an internal thread is formed in the at least one torque transmission element for the reception of a screw provided for the screw connection of the blade at the blade mount.

3. The blade mount in accordance with claim 1,
in which an axial dimension of the at least one torque transmission element is smaller than an axial dimension of the blade.

4. The blade mount in accordance with claim 1,
in which the at least one torque transmission element has an outer contour matched to an associated aperture of the blade.

5. The blade mount in accordance with claim 1,
in which the at least one torque transmission element is one of a plurality of torque transmission elements.

6. The blade mount in accordance with claim 5,
in which all the torque transmission elements have the same radial spacing from the mount section.

7. The blade mount in accordance with claim 5,
in which all the torque transmission elements are arranged evenly distributed along a circular path arranged concentrically with the mount section.

8. The blade mount in accordance with claim 1,
in which the mount section is configured as at least sectionally cylindrical and is adapted to an associated circular central opening of the blade.

9. The blade mount in accordance with claim 8,
wherein at least one part section of the mount section adjacent to the contact surface forms a fit corresponding to the central opening of the blade and a free end of the mount section has an outer diameter reduced with respect to the part section.

10. The blade mount in accordance with claim 1,
wherein the mount section defines an inner space which is open at the end face and which is aligned concentrically with the mount section so that a ring-shaped wall is produced, and
wherein at least one prefixing pin projects radially out of the ring-shaped wall into the inner space.

11. A system comprising a blade mount in accordance with claim 1, the blade which can be fastened to the blade mount and a handling apparatus for assembling or dismantling the blade at the blade mount, the handling apparatus comprising:
at least one means for the releasable attachment of the handling apparatus to the blade; and
a prefixing element which can engage through a central opening of the blade attached to the handling apparatus and which can be introduced into the inner space of the mount section of the blade mount of the cutting machine
wherein at least one guide for the at least one prefixing pin of the blade mount is provided at a jacket surface of the prefixing element.

12. The system in accordance with claim 11, wherein the prefixing element is matched to the contour of the inner space.

13. The system in accordance with claim 11,
wherein the guide is configured such that it allows a first axial movement of the prefixing element into the inner space, a rotation of the prefixing element into the inner space and a subsequent second axial movement of the prefixing element into the inner space.

14. The system in accordance with claim 13, in which the guide is configured as a slot guide and comprises an axially extending first groove section and a second groove section adjoining it and extending in the peripheral direction,
wherein the slot guide additionally comprises an axially extending third groove section which extends, starting from the second groove section, in a direction opposite to the first groove section.

15. The system in accordance with claim 13, in which the guide is configured as a slot guide and comprises an axially extending first groove section and a second groove section adjoining it and extending in the peripheral direction, wherein the width of at least a portion of the second groove section extending in the peripheral direction is larger than a maximum dimension of the prefixing element.

* * * * *